US007654533B2

(12) United States Patent
Seal

(10) Patent No.: US 7,654,533 B2
(45) Date of Patent: Feb. 2, 2010

(54) NUMERIC GUESSING GAME

(76) Inventor: Bernard Seal, 19211 Prairie St., Northridge, CA (US) 91324

( * ) Notice: Subject to any disclaimer, the term of this patent is extended or adjusted under 35 U.S.C. 154(b) by 130 days.

(21) Appl. No.: 11/737,084

(22) Filed: Apr. 18, 2007

(65) Prior Publication Data

US 2007/0246888 A1 Oct. 25, 2007

Related U.S. Application Data

(60) Provisional application No. 60/793,166, filed on Apr. 18, 2006.

(51) Int. Cl.
*A63F 9/14* (2006.01)

(52) U.S. Cl. ..... 273/429; 273/430; 273/432

(58) Field of Classification Search ..... 273/429, 273/430, 431, 432; 434/186, 191, 322
See application file for complete search history.

(56) References Cited

U.S. PATENT DOCUMENTS 5,219,433 A * 6/1993 Zaruba et al. ..... 273/432

(Continued)

OTHER PUBLICATIONS

Wits & Wagers, from boardgamegeek.com website at http://boardgamegeek.com/boardgame/20100 and Northstar Games website at http://www.northstargames.com/pdf/WebsiteRules_LowRez.pdf, 2005.*

(Continued)

*Primary Examiner*—William M Pierce
(74) *Attorney, Agent, or Firm*—Christie, Parker & Hale, LLP.

(57) ABSTRACT

A game is provided wherein a player or team gains points by answering a question worded in such a way that the answer is always a number. In one embodiment, the questions are directed to points of trivia or general or specific knowledge, and the game includes a plurality of question cards, on the reverse side of which are the answers to the questions. The questions are such that players can make an informed or educated guess at the numeric answer. The object of the game is to answer each question by coming closer to the correct numeric answer than the opposing players. In one embodiment, players are given a preselected amount of time, as determined by a timing device, to write down their answers. Once the players have written down their answers, all players may display their numeric answers simultaneously. The player or team that comes closest to the answer given on the card gets more points than the other players or teams. In another embodiment, players or teams that come second closest, third closest etc. to the correct numeric answer also receive points. In a unique scoring system, made possible by the fact that all answers are numeric, the number of points players receive for their answers may depend on two factors: how close the answer is to the correct number and how many players or teams are taking part in the game. In one embodiment of the game, players answer a given number of questions and the winner is the player with the highest score at the end of the game. In another embodiment of the game, players move game pieces across a game board with the first player to reach the end of the board being the winner. Further, the game may be played on alternate game interfaces, such as a computer.

20 Claims, 8 Drawing Sheets

U.S. PATENT DOCUMENTS

| | | | | |
|---|---|---|---|---|
| 5,660,389 | A * | 8/1997 | Freda, III | 273/249 |
| 5,735,522 | A * | 4/1998 | Sausa | 273/249 |
| 6,394,899 | B1 * | 5/2002 | Walker | 463/9 |
| 6,863,606 | B1 * | 3/2005 | Berg et al. | 463/16 |
| 2002/0160825 | A1 * | 10/2002 | Nicastro et al. | 463/16 |
| 2003/0071416 | A1 * | 4/2003 | Vancura | 273/274 |
| 2004/0036216 | A1 * | 2/2004 | Vancura | 273/274 |
| 2004/0160009 | A1 * | 8/2004 | Vancura et al. | 273/292 |
| 2008/0012225 | A1 * | 1/2008 | Vancura et al. | 273/292 |

OTHER PUBLICATIONS

Fast Figure question and answer board game , from Board Game Geek website at http://boardgamegeek.com/boardgame/7827, 2003.*

Intensity (a.k.a. In10sity) trivia board game, from Board Game Geek website at http://boardgamegeek.com/boardgame/21382, 2005.*

* cited by examiner

FIG 2

32

SAMPLE QUESTIONS

1 What percentage of new automobiles sold in the United States are cars (that is they are not SUVs, vans, pickups, or wagons)? (November 2006)
2 How many people are there in the world over the age of 110? (August 2006)
3 What is the average cost for a family of four to go to a major league baseball game, buying four seats, two beers, four soft drinks, four hot dogs, two programs, and two baseball caps? (October 2006)
4 How high is Niagara Falls?
5 What percentage of Americans say that a dog makes a better pet than a cat?
6 In what year does the Census Bureau predict that the U.S. population will reach 400 million? (October 2006)
7 How long did it take Lindbergh to complete his historic transatlantic flight in 1927?
8 How many U.S. states border an ocean?
9 How old was the oldest man to ever win a gold medal at the summer Olympics?
10 In one hour of TV watching, a 150-pound person will burn 68 calories. How many calories would the same person burn doing tap dancing?
11 In what year did Leonardo Da Vinci paint the Mona Lisa?
12 What percentage of first marriages in the United States end in divorce? (January 2006)
13 What is the circumference of the earth at the equator?
14 How old was Bob Marley when he died?
15 In November 1979, 66 Americans were seized and held hostage in Iran. How many days was it before the last hostage was freed?
16 When Americans were asked in 2006 if they have ever played golf, what percentage answered "yes."
17 The average human heart beat is 72 beats per second. What is the average heart beat of a mouse?
18 In 1976, the average age for an American woman having her first baby was 21.4 years of age. What was it in 2004?
19 What was the average income tax refund in 2006?
20 According to the Census Bureau, how many American Indians/Alaskan Indians are there living in the United States? (December 2005)
21 According to the National Coffee Association, what percentage of coffee consumed in the United States is decaf? (October 2006)
22 What is the average weight of a sumo wrestler?
23 In what year did the first zoo in the United States open its gates to the public?
24 How many midgets were in the cast of the 1939 movie, "The Wizard of Oz"?
25 What percentage of Americans aged 25-29 have a tattoo? (July 2003)

FIG 3
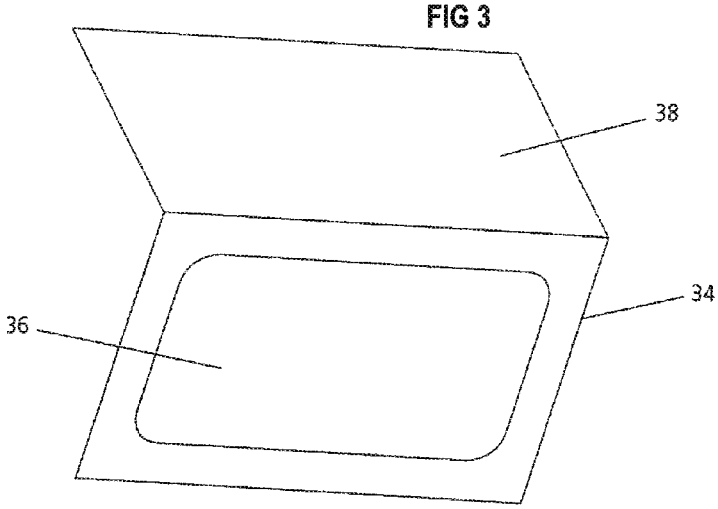
FI G 4
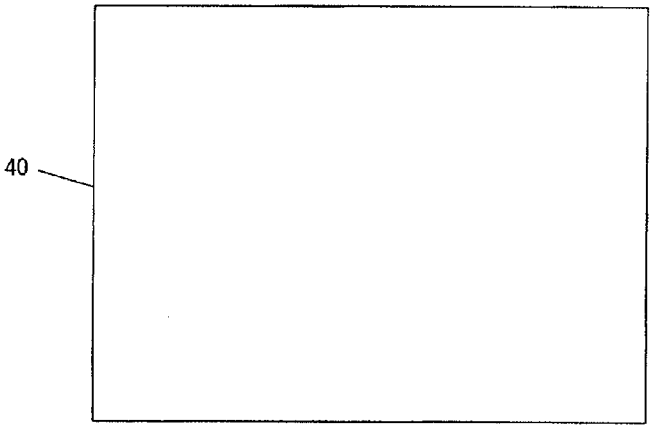
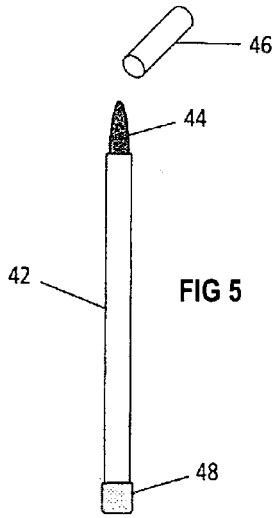
FIG 5

FIG 8
Scoring chart 70 72 74

| | 2 teams or players | 3 teams or players | 4 teams or players | 5 teams or players |
|---|---|---|---|---|
| 1st | 2 (4) | 3 (6) | 4 (8) | 5 (10) |
| 2nd | 0 | 1 (2) | 2 (4) | 3 (6) |
| 3rd | — | 0 | 1 (2) | 2 (4) |
| 4th | — | — | 0 | 1 (2) |
| 5th | — | — | — | 0 |

76 78 80

NUMERIC GUESSING GAME

CROSS-REFERENCE TO RELATED APPLICATION(S)

This application claims the benefit of U.S. Provisional Application No. 60/793,166, filed Apr. 18, 2006.

FIELD OF THE INVENTION

The present invention relates to games in which questions are posed and answered. Such games often involve questions on cards and a board on which a player moves a game piece toward a desired goal, the rate of progress depends on the ability of the player to answer correctly the question on the card.

BACKGROUND OF THE INVENTION

Various games have been proposed to test players'knowledge when played by groups or individuals for entertainment purposes. Such games often include questions on diverse subjects posed to individuals or teams of individuals. In some games, questions are assigned discrete point values related to the difficulty of the question. Other general knowledge games have been developed which include board game elements, wherein the players move game pieces across the surface of a game board to determine the particular questions to be answered. These board-type games are particularly well suited to home or party use by small groups of players.

Games that test the knowledge of players have been known and popular for centuries. More recently, games involving the testing of trivial knowledge have gained enormous popularity.

An example of a board-type trivia game is TRIVIAL PURSUIT ®, which involves answering questions and moving a game piece around a board by rolling a die. Each space a player lands on is associated with a particular category of question. When the player lands on that category, the player answers questions from the category. If the question is answered correctly, the player rolls again and continues to answer questions until failing to provide the correct answer. The first time a player answers a question for a particular category, the player receives a colored wedge to fit into the game piece. The game ends when a player has filled his or her game piece with all of the different colored wedges, has successfully moved his or her game piece to the center of the board, and has successfully answered a final question on a category of the other players'choosing.

SUMMARY OF THE INVENTION

The present invention provides entertainment while challenging the knowledge and guessing ability of players, or teams of players, typically under a time deadline, to come up with numeric answers to questions involving trivia or general or specific knowledge. It also provides a unique system of play that ensures competitiveness and full participation from all players at all times. Players are motivated by a scoring system that gives credit for achieving a better answer than an opponent, even when both answers are technically incorrect.

The game may be played by any number of players, either individually or in teams;

however, it is played most advantageously as a team game since interaction between team players pooling their knowledge and helping each other settle on an answer enhances the enjoyment of the game. Hence, it is recommended that whenever four or more people assemble to play the game, they should form teams of players.

In a particular embodiment, the game is a trivia game in which all of the questions have numeric answers. A question that can be answered only by a number may take many forms. Examples are: What is the average distance between the earth and the moon? How many stories are there in the Empire State building? In what year was the zipper invented? What percentage of Americans drink their coffee black? Questions are such that the answers may be in miles, feet, inches, hours, seconds, yards, years, dollars, percentages, and so on. In other words, any question in which the answer can be expressed in the form of a number is possible.

In another embodiment of the game, the topics of the questions are such that players with encyclopedic minds and excellent recall are not necessarily at an advantage. In this embodiment, all questions relate in some way to the contemporary world. These questions require players to make a calculated, well-informed guess based on their real world knowledge. The data upon which these questions are based are to be found in newspaper polls, magazine surveys, and on the Web, and as such, it is highly unlikely that players will know the exact answers. Examples of questions of this type might be "How many Tee shirts does the average American own?" or "What is the average cost of a wedding in the United States?" or "What percentage of American adults identify themselves as 'extremely' or 'very' patriotic?"

In a further embodiment, all players answer all questions and do so simultaneously. In many trivia games, players answer their own questions only and can be "lucky" by drawing easier questions than their opponents. Further, in many games, a player who answers a question correctly goes on to attempt to answer another question. This feature of many trivia games means that often times players, especially the less well-informed, spend a large amount of time observing and not playing and soon lose interest. In the present invention, a question is drawn from a pile and is answered simultaneously by all players. Players write their numeric answers down on a special erasable board and then all players reveal their answers at exactly the same time to avoid cheating.

In yet another embodiment, the invention involves a unique scoring system which is made possible by the fact that all answers are numeric. Players may receive points based on whether they are nearer or farther from the correct score than their opponents. Thus, it is possible for a wildly incorrect score to get maximum points because all other players have even more wildly incorrect scores. Not only does the nearest to the correct answer receive maximum points, but the second nearest may also receive points. Thus, the player with the answer second nearest to the correct answer may still receive points, but fewer than the player with the nearest answer.

Likewise, the player with the third nearest answer may receive points, but fewer than the second nearest and so on. The fact that players can receive points for incorrect answers adds to the excitement of the game and provides motivation for players.

In one embodiment, a bonus point system may also be employed to add motivation to the game. Again, such a system is made possible because all answers are numeric. In another embodiment of the game, any player or team guessing a number within a preselected acceptable range around the correct answer gets a bonus point. For example, if the answer to a question is 100, an acceptable range to get a bonus point may be any response that is within the range 85 and 115. The "extra point range" is given on the reverse side of the question card, following the correct answer.

As an example, play may proceed in the following manner. A question card is drawn and asked. Players write down their answers and then reveal them at the same time. Points and bonus points are allotted to players for each question. A total of twenty-five questions in five rounds of five questions each may be asked in this manner. In the fifth round, scores may double, thus allowing players who have fallen behind in the other four rounds a chance to catch up. In any case, the scores are recorded and the player with the highest score wins.

In a further embodiment of the game, a player receives points as above for their answers, but instead of writing down the scores on a score sheet, players move a game piece across a game board, moving their game piece a number of spaces related to the score they received for answering the question. The first player to advance from the first square to the final square is the winner.

As can be seen from the above, the invention may involve a trivia or other general information game in which all questions are answerable by numbers, all players are involved at all times, and the scoring system motivates all players.

BRIEF DESCRIPTION OF THE DRAWINGS

FIG. 2 is a listing of sample questions;

FIG. 3 is an isometric view of a holder, which may be optional, for the question card of FIGS. 1A and 1B;

FIG. 4 is a plan view of a board or card for reporting an answer to a group in the course of a game practiced according to an embodiment of the invention;

FIG. 5 is a plan view of a dry erase pen for writing on the board or card of FIG. 4, with its cap removed;

FIG. 8 is a scoring chart according to an embodiment of the invention showing the number of points that players receive when there are two, three, four, or five players in a game according to the invention.

DETAILED DESCRIPTION OF THE INVENTION

Figure 1A:
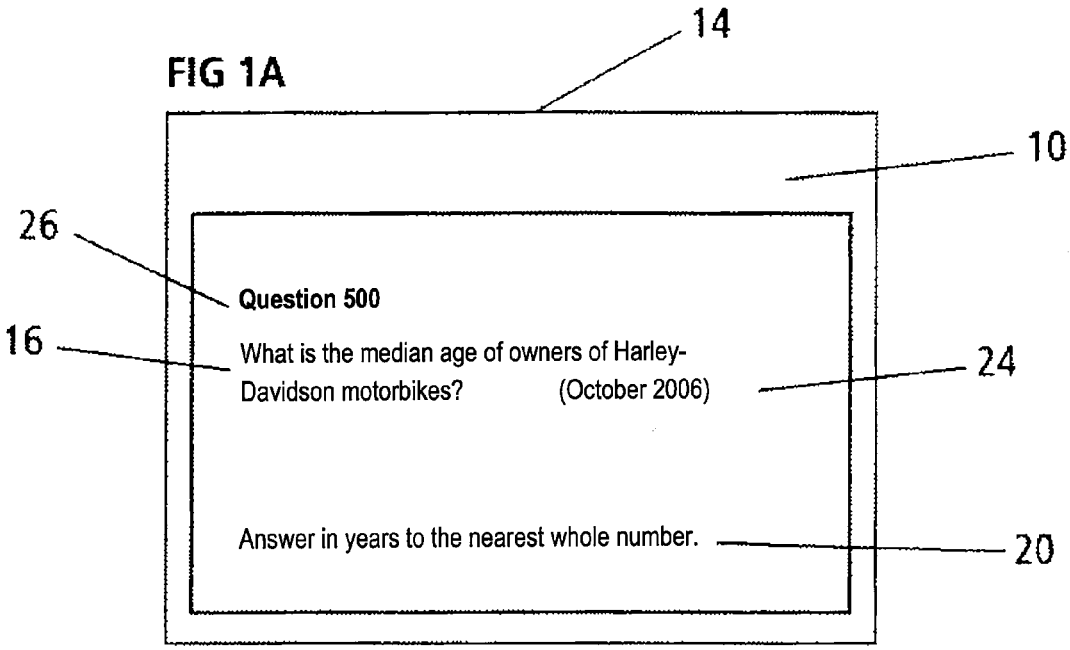
FIG. 1A depicts an example of a question card for use in a game according to one embodiment of the invention, showing a question on one side of the card.
Figure 1B:
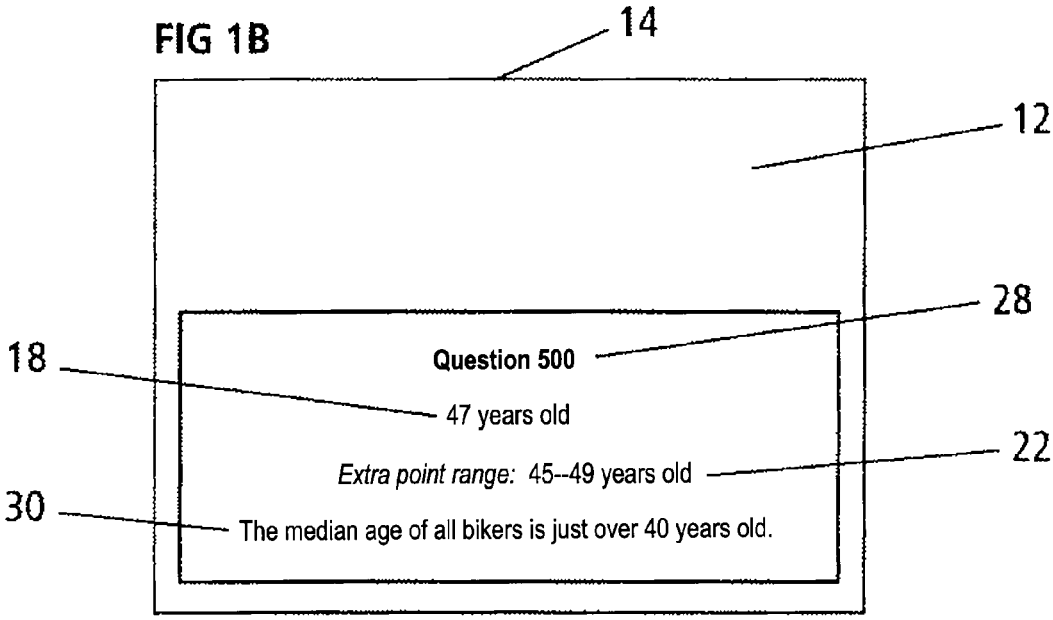
FIG. 1B illustrates the reverse side of the question card of FIG. 1A, in which the answer to the question of FIG. 1A appears.

The game is played using a plurality of question cards. FIGS. 1A and 1B illustrate first and second sides 10 and 12 of a question card 14, constructed according to one embodiment of the game. On the first side 10 of the question card 14 is a question 16 of trivia or general or specific knowledge that is framed in such a way that the answer is always a number. On the second side 12 of the question card 14 is a given numerical answer 18 to the question 16.

Following the question 16 on the first side 10 is a clue 20 as to how to answer the question 16. This clue 20 may tell the players, for example, to answer the question 16 as a whole number or to the nearest million or to the nearest decimal point.

A range of numbers 22, called the extra or "bonus" point range, is shown following the answer 18. These numbers show a range of acceptable answers for which a bonus point may be scored (see scoring system).

Since the answers to many of the numeric questions may vary over time, the month and year for which the answers to the questions on the card were correct is given in parentheses. On the first side 10, the month and year October 2006, designated by the numeral 24, shows the month and year when it was true, i.e., when the median age of owners of Harley-Davidson motorcycles was 47 years of age.

The question cards may be numbered, as indicated in FIGS. 1A and 1B by 26 and 28, respectively. In a game containing five hundred questions, for example, there may be 500 cards numbered 001-500. More cards are, of course, possible. Alternatively, fewer cards with more questions on each card are possible.

In some cases, additional information 30 about the answer 18 may appear below the extra point range of numbers 22.

In one embodiment of the game, the questions may address a wide variety of topics: the animal world, human achievements, sports achievements, historical events, inventions, geographical facts, popular American culture, and so on. FIG. 2 provides an illustrative example of twenty-five possible questions 32, many of which are derived from surveys and polls conducted by newspapers, magazines, and commercial companies. It is thus highly unlikely that players will know or will have read the answers to these questions. Instead, they must guess at the numeric answers using logical reasoning and real world knowledge. In this embodiment of the game, the questions have a distinctly American bent. However, it is quite possible to have different international versions in which the questions would be framed so that they would test a player's knowledge of a different country with which they are familiar.

The sample questions 32 of FIG. 2 relate to an embodiment of the game in which questions are not categorized. While it may be desirable to play the game with a random mix of questions on a wide variety of topics, it is also possible to construct an embodiment of the game in to which questions are categorized. In such an embodiment, players or teams may choose to select certain questions to answer based on the category they believe they are most likely to be able to answer well.

The sample questions 32 in FIG. 2 are questions from an embodiment of the game in which questions address a variety of topics. It is also possible to have an embodiment in which all questions have to do with one topic, such as sports trivia, entertainment trivia, historical trivia, etc.

Another embodiment of the game might be a children's version, in which all questions are such that a pre-teen might be able to answer. Still another embodiment of the game might be for mature adults only, in which questions are in some way risqué or sexual in nature.

Method of play

Play proceeds in the following manner. One player is selected to take a first question card 14 from a box. The player may quickly place the question card 14 in a special question card holder, as illustrated in FIG. 3. The question card holder 34 of FIG. 3 is designed in such a way that when the question card 14 is placed in the holder 34, it is possible to read the question 16 on the first side 10 of the card 14. This is because the holder is designed like a picture frame with an open space 36 in the center, through which the question can be read. A flap 38 on the question card holder 34 is cut in such a way that when it is time to reveal the answer 18 on the second (reverse) side 12 of the card 14, the flap 38 can be lifted to reveal the answer 18. This system is designed so the answer to the question posed cannot be seen until it is needed.

Play continues in the following manner. First, the question is read. Different readers may elect to read the question. Although there is no special advantage in reading the question, there is some pleasure to be derived in reading out the question, so a system of rotating the asking of the question can be worked out in advance by the players.

Figure 6:
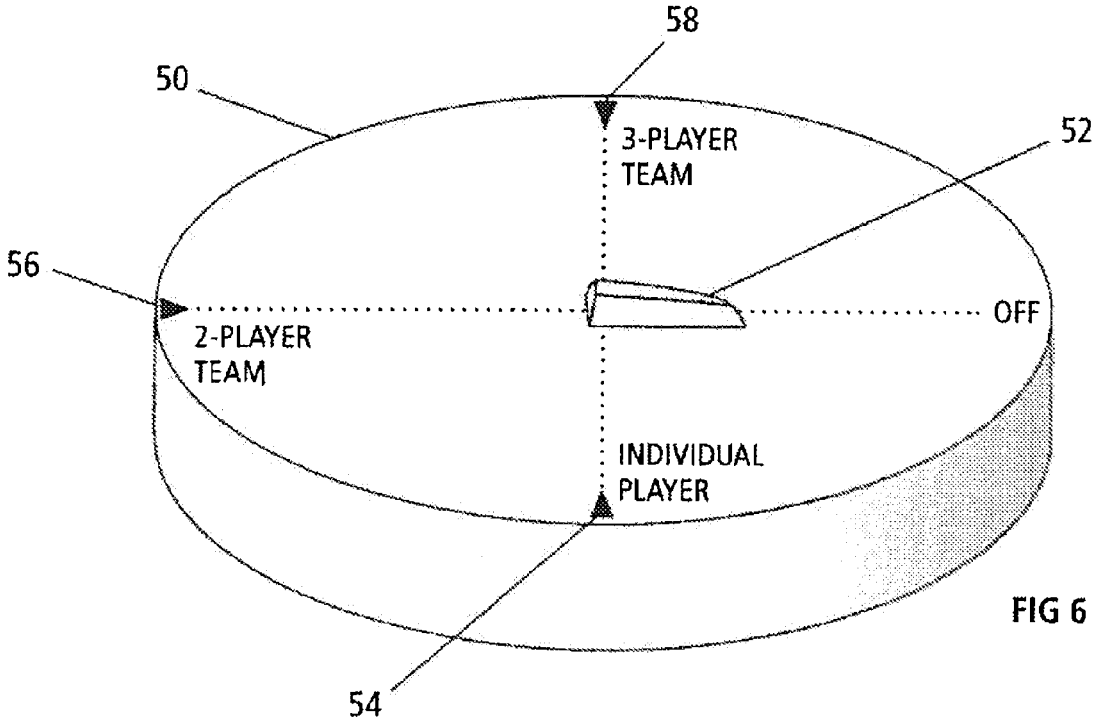
FIG. 6 is an isometric view of a timer with three settings for use in a game according to an embodiment of the invention.

Immediately after the question has been read, a timing device may be activated (FIG. 6). FIG. 6 illustrates a possible timing device 50. The clockwork mechanism inside the timing device 50 is not shown, but it is designed so that a knob 52 may be moved to different settings 54, 56, and 58 to control the amount of time to be measured. By moving the knob 52 to one of these settings 54, 56, and 58, and releasing it, the clockwork mechanism is caused to run for different periods of time. The different settings are required because different amounts of time are needed to answer questions depending on how many players or teams of players are playing the game. When the guessing game is not played in teams, but by individuals playing against each other, relatively little time is necessary to come up with a guessed answer to the question. In this situation, the knob 52 would be moved to the setting for an individual-player game 54. However, when players play in teams, more time is necessary for the players to confer and agree on an answer. Thus, when two players play on a team, more time is required than when players are playing individually. When three or more players are on a team, even more time is necessary. Hence there are two other settings on the timing device 50. One setting 56 is used when teams of two players are playing the game; the other setting 58 is used when teams of three or more players are playing the game. The setting 54 for individual-player games may provide about 20 seconds for players to answer; the second setting 56 may provide about 40 seconds for teams of two players to answer; and the third setting 58 may provide teams of three players or more about one minute to come up with an answer.

FIG. 4 shows an answer report card or board 40 on which players furtively record their numeric answers. This card 40 is made out of dry-erase material so that each answer may be erased in preparation for answering the next question. FIG. 5 depicts a dry-erase pen 42 that each player or team uses to write on their dry erase boards. The pen 42 has a tip 44, a top 46 on one end, and a dry-erase eraser 48 on the other end. In other embodiments of the game, different game materials may be used for recording answers, such as pencil and paper.

When the preselected period of time runs out, the timer 50 may make a loud clacking noise, by which time players must have made their final decisions and entered an answer on their answer report cards 40. A designated player may then say something like "Contestants, hold up your answers!" Players then hold up their answer report cards 40 so that everyone can see the numeric answers written on the cards. The same designated player then lifts the flap 38 of the question holder 34 and reads the answer 18 on the reverse side of the question card 14.

Once the answer has been read, it is necessary to calculate which player or team has written a number that is closest to the answer 18 on the card 14. It is also necessary to calculate which player or team has recorded a number that is second closest to the answer and so on. It is useful, therefore, when playing the game to have a calculator handy. Points are then assigned to answers (see scoring system below).

Figure 7:
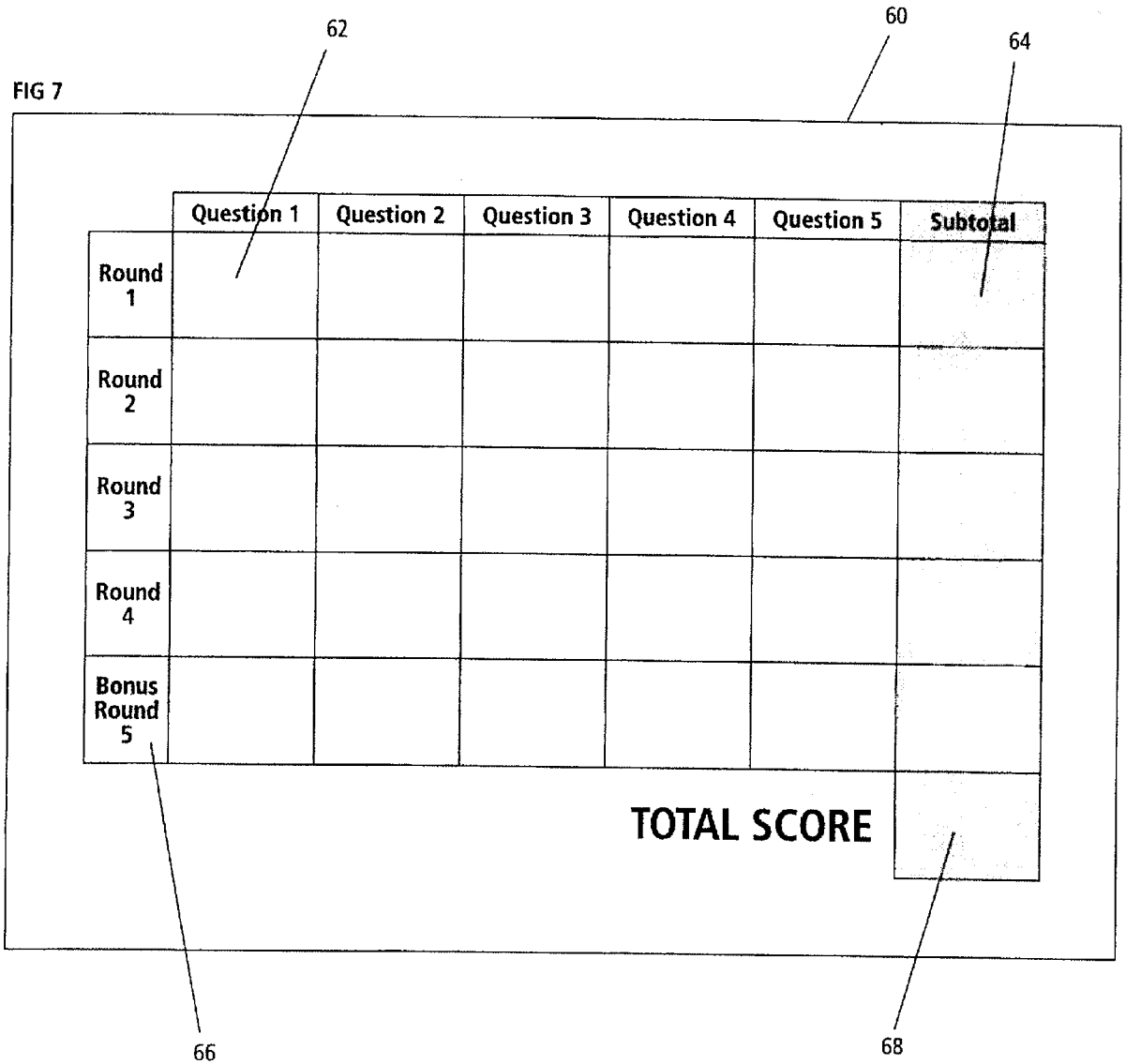
FIG. 7 shows a score report card usable in a game according to the invention.

FIG. 7 illustrates a score card 60 that can be used in one embodiment of the game. For each question, an area 62 of the score card 60 is designated as a place to write the number of points earned for each answer.

As can be seen from the score card 60, in one embodiment of the game, players answer a total of 25 questions. They answer five rounds of questions with five questions in each round. At the end of each round, players add up the points they received for their five answers and write the total for the round in a designated area 64 of the score card 60. The fifth round is the bonus round 66. The points scored for each answer are doubled in this round, allowing players who have fallen behind in the other four rounds a chance to catch up and win in the final round. After the fifth question of the fifth round has been answered and scored, the scores earned for all five rounds are added up and the total score for the whole game is written in the designated area 68 of the score card 60. The winner of the game is the player or team with the highest number of points from their twenty-five answers.

Figure 9:
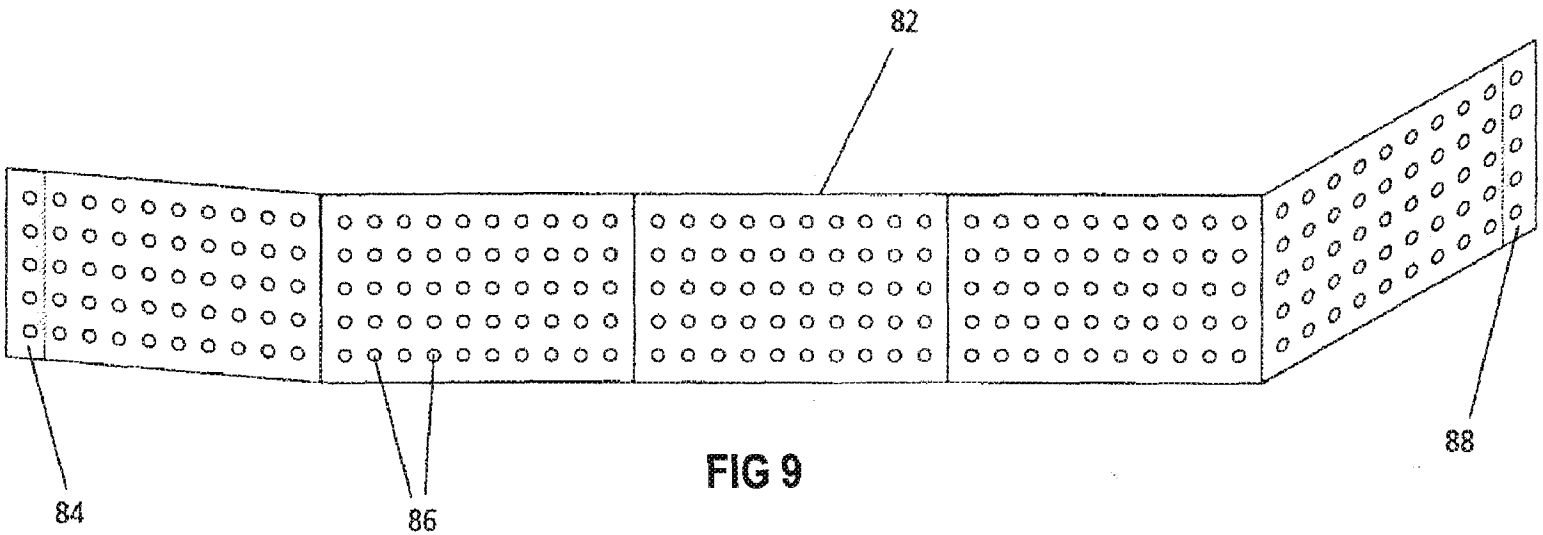
FIG. 9 shows a game board for use in playing the game according to an embodiment of the invention.
Figure 10:
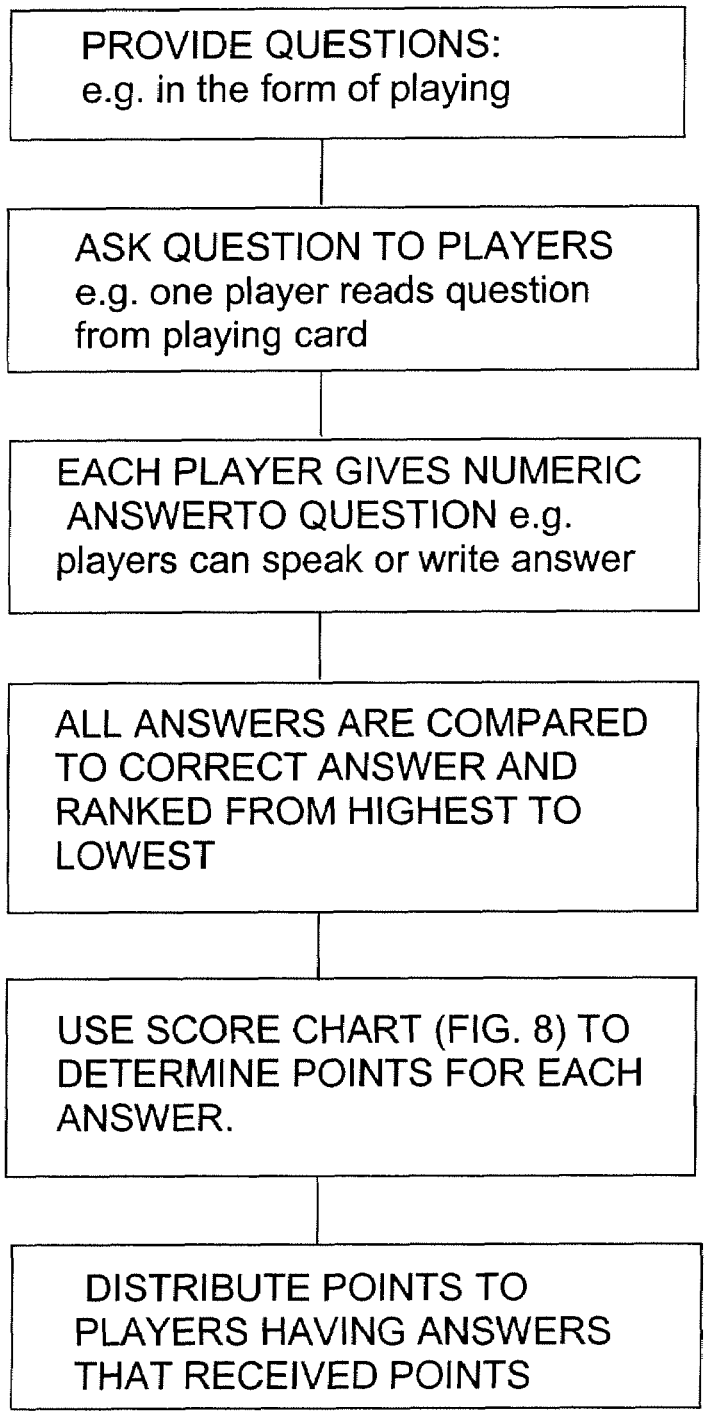
FIG. 10 shows a Flow Chart detailing the steps of playing the game according to an embodiment of the invention.

FIG. 9 illustrates a game board 82 that can be used in a game-board embodiment of the game. In this embodiment, each player or team has a game piece that starts at a starting line 84. Each space 86 on the board 82 represents a point earned by a player or team for an answer. Thus players move forward from one of the spaces 86 to a succeeding space 86 according to the number of points earned for a question. The player who reaches the finish line 88 first is the winner.

In a particular board embodiment of the game, there is no doubling of points at any time in the game.

Scoring

FIG. 8 illustrates a scoring chart 70 that shows how players assign points for their answers. The player or team that places first for a question, that is gets closest to the correct answer, gets the same number of points as there are players or teams in the game. See, for example, the column 72 of the chart 70 for a game in which there are four players or four teams of players. In the first row of the column 74, we see that the player who gets closest to the answer gets 4 points (because there are four players or teams). As can be seen from the second row in that column 76, a player with the second closest answer gets 2 points. From the third row in the column 78, we see that the player with the third closest answer gets 1 point. The fourth row in the column 80 shows that only the player with the least close answer gets zero points.

The figures in parentheses in the scoring chart 70 show the points that can be scored in the fifth and final bonus round of the game.

In the event that a player or team ties for 1st, 2nd, or 3rd place, they each score the same number of points for that placement. For example, if two players in a 4-player game share first place, they both get 4 points; if two players share second place in a 5-player game, each player or team gets 3 points.

Bonus points may also be awarded for each answer. Any player or team that gets within the extra point range 22 gets a bonus point. And any player that gets the exact answer 18 gets an additional bonus point. The player or team that gets the exact answer 18 in fact gets two bonus points: one for an answer that falls within the extra point range 22 and one additional point for getting the exact answer 18.

Although the present invention has been described with reference to the particular embodiments herein set forth, it is understood that the present disclosure has been made only by way of example and that numerous changes in details of construction may be resorted to without departing from the spirit and scope of the invention. For instance, it is contemplated that the game described herein may also be played on a computer or a hand-held game device, or may be conducted as a game show particularly suited for television performances. The manner in which the game could be reduced to a software version or made into a TV show would be apparent to those skilled in that art. Thus, the scope of the invention should not be limited by the foregoing specification, but rather only by the scope of the claims appended hereto.

What is claimed is:

1. A method of playing a question and answer game among a plurality of players comprising:

providing a plurality of questions having numeric answers;

providing a scoring chart;

posing one of the plurality of questions to the players;

receiving numeric answers to the posed question from the players;

comparing the received numeric answers to a given numeric answer;

ranking the received numeric answers from a highest rank to a lowest rank based on how close the received numeric answers are to the given numeric answer;

assigning points to the ranked numeric answers based on a predetermined number of points indicated for each rank in the scoring chart; and attributing score points to the players based on the points assigned to their numeric answers.

2. The method of claim 1 wherein the predetermined number of points indicated for each rank in the scoring chart is based on the number of players.

3. The method of claim 2 wherein at least one additional score point is attributed to a player whose numeric answer is within a preselected numeric range of the given numeric answer.

4. The method of claim 3 wherein at least one other additional score point is attributed to a player or team whose numeric answer exactly matches the given numeric answer.

5. The method of claim 1 wherein the game is played by at least three players organized into teams.

6. The method of claim 1 wherein the game is played by at least four players organized into teams of equal numbers.

7. The method of claim 1 wherein the players write down their numeric answers and reveal them to each other in written form.

8. The method of claim 7 wherein the players reveal their written numeric answers to each other simultaneously.

9. The method of claim 1 wherein each player is assigned a game piece and moves his or her game piece across the surface of a game board a distance related to the number of points attributed to him or her.

10. The method of claim 1 wherein a game is played in a plurality of rounds each having a plurality of different questions, and wherein an increased number of points is given for each question in a final round.

11. The method of claim 1 wherein a plurality of game cards are provided, each game card bearing one question and one answer on opposite sides thereof.

12. The method of claim 11 wherein at least 100 game cards are provided.

13. The method of claim 12 wherein at least 500 game cards are provided.

14. The method of claim 1 wherein the questions are categorized by subject matter.

15. The method of claim 1 wherein all of the questions are directed to a particular subject area.

16. The method of claim 1 wherein the questions are directed to at least one selected from the animal world, human achievements, sports achievements, historical events, inventions, geographical facts, and popular American culture.

17. The method of claim 1 wherein each of the players is required to provide a numeric answer within a preselected period of time.

18. The method of claim 17 wherein the preselected period of time is measured by a timing device.

19. The method of claim 17 wherein the preselected period of time depends on the number of players playing the game.

20. The method of claim 18 wherein the preselected period of time is at least 20 seconds.

* * * * *